US007222506B2

(12) United States Patent
Yu

(10) Patent No.: US 7,222,506 B2
(45) Date of Patent: May 29, 2007

(54) SECURITY CHECK HANGING LOCK STRUCTURE

(76) Inventor: Chun-Te Yu, No.41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 11/036,054

(22) Filed: Jan. 18, 2005

(65) Prior Publication Data

US 2006/0156769 A1 Jul. 20, 2006

(51) Int. Cl.
*E05B 37/06* (2006.01)

(52) U.S. Cl. ..... 70/21; 70/25; 70/28; 70/284; 70/312

(58) Field of Classification Search ..... 70/21–29, 70/312, 284, 285, 38, 45–47
See application file for complete search history.

(56) References Cited

U.S. PATENT DOCUMENTS 5,782,113 A * 7/1998 Chen ..... 70/28
5,901,587 A * 5/1999 Chen ..... 70/28
6,792,778 B1 * 9/2004 Chen ..... 70/21
6,848,283 B1 * 2/2005 Lin ..... 70/21
6,928,842 B1 * 8/2005 Huang ..... 70/21
6,997,023 B1 * 2/2006 Huang ..... 70/21
2004/0226323 A1 * 11/2004 Ling et al. ..... 70/25
2005/0034492 A1 * 2/2005 Yu ..... 70/25

* cited by examiner

*Primary Examiner*—Suzanne Dino Barrett
(74) *Attorney, Agent, or Firm*—Alan Kamrath; Kamrath & Associates PA

(57) ABSTRACT

A security check hanging lock structure including a lock housing, a first (private) lock mechanism, a second (common) lock mechanism, a first locking member and a second locking member. Each of the first and second locking members has a base end pivotally disposed in the lock housing and a free end extending to outer side of the lock housing. The free ends of the first and second locking members are connectable to form a hanging hook. The first and second lock mechanisms are disposed in the lock housing for drivingly controlling the movement of the first and second locking members. By means of unlocking the first and second lock mechanisms, the free ends of the first and second locking members can be respectively driven to displace away from each other so as to unlock the hanging lock in two manners.

12 Claims, 8 Drawing Sheets

SECURITY CHECK HANGING LOCK STRUCTURE

BACKGROUND OF THE INVENTION

The present invention is related to an improved security check lock structure including two independent lock mechanisms for driving two locking members which are connected to form a hanging hook. By means of unlocking the lock mechanisms, the locking members can be respectively driven to open the hanging hook. Therefore, the hanging lock is unlockable in multiple manners.

In response to the recent terror activities, the customs of respective countries have checked the baggage of the passengers more and more strictly. In order to minify the affection and inconvenience to the passengers, it is a trend to equip the baggage case with a security check lock structure which is unlockable in at least two manners (generally in two manners ). All the lock apparatuses manufactured by the same manufacturer are set also unlockable by a specific common key owned by the customs. Accordingly, when passing through the customs, the security check can be conveniently performed. Also, it is more convenient to use such lock-apparatuses.

Taiwanese Patent Publication No. 247655 discloses a security check lock structure including: a lock housing; a slide member movably disposed in the lock housing, the slide member having an internal slide space; a lock hook having a root section and a free end, the root section being movably disposed in the slide space of the slide member, the free end being synchronously movable with the root section between a first position and a second position. When the free end is positioned in the first position, the free end is inserted in the lock housing. When the free end is positioned in the second position, the free end is separated from the lock housing; a private lock mechanism disposed in the lock housing for driving the slide member to control the movement of the root section of the lock hook; and a common lock mechanism disposed in the lock housing for controlling the movement of the root section of the lock hook within the slide space.

In the above security check lock structure, the two lock mechanisms serve to control one single lock hook so as to lock or unlock the lock structure. The design of such lock structure is limited.

SUMMARY OF THE INVENTION

It is therefore a primary object of the present invention to provide an improved security check hanging lock structure including a lock housing, two locking members and two independent lock mechanisms. Each locking member has a base end pivotally disposed in the lock housing and a free end extending to outer side of the lock housing. The free ends of the locking members are connectable to form a hanging hook. The lock mechanisms are disposed in the lock housing for controlling the movement of the first and second locking members. By means of unlocking the first and second lock mechanisms, the free ends of the first and second locking members can be respectively driven to displace away from each other so as to unlock the hanging lock in at least two manners.

The present invention can be best understood through the following description and accompanying drawings wherein:

DETAILED DESCRIPTION OF THE PREFERRED EMBODIMENTS

Figure 1:
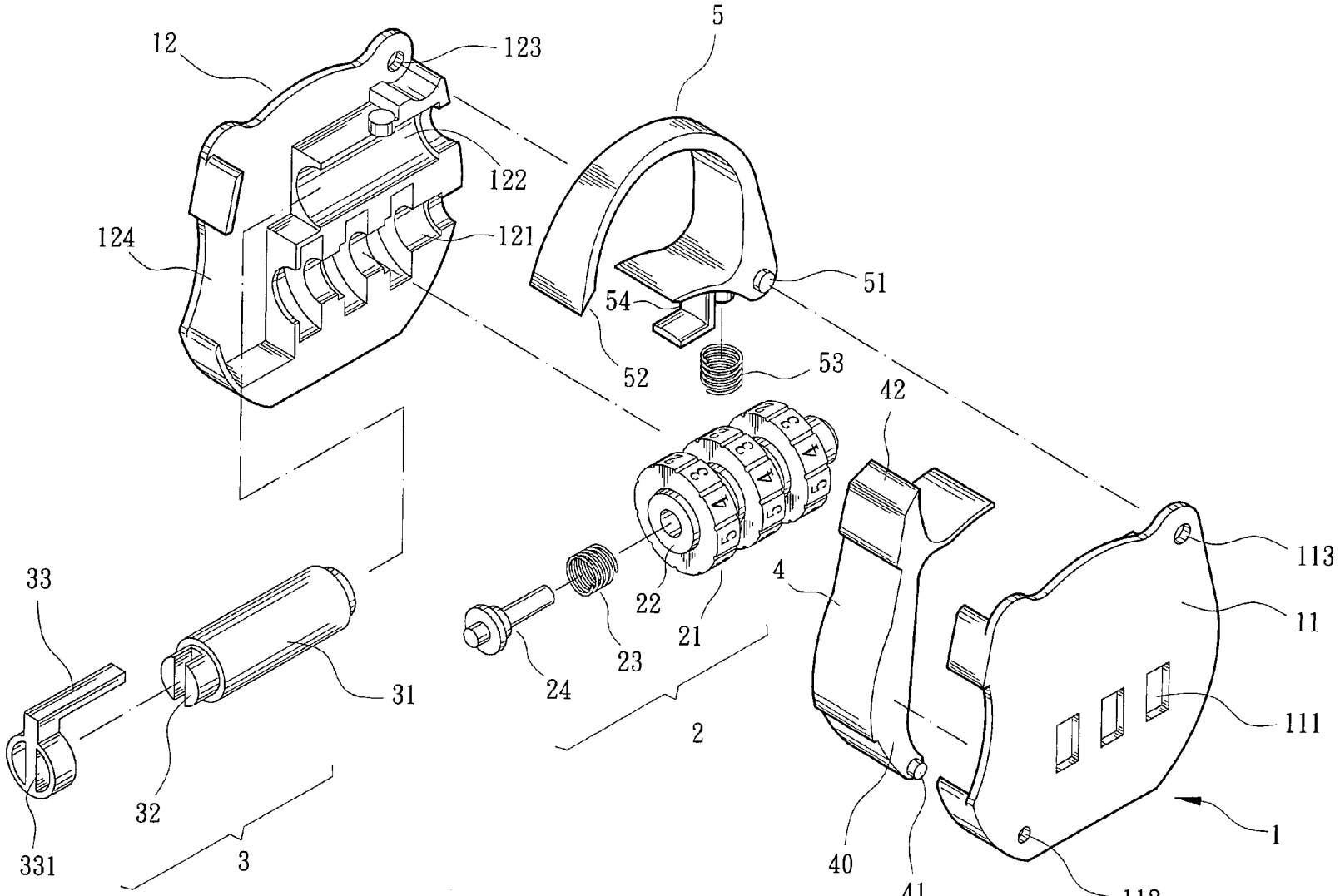
FIG. 1 is a perspective exploded view of a first embodiment of the present invention.
Figure 2:
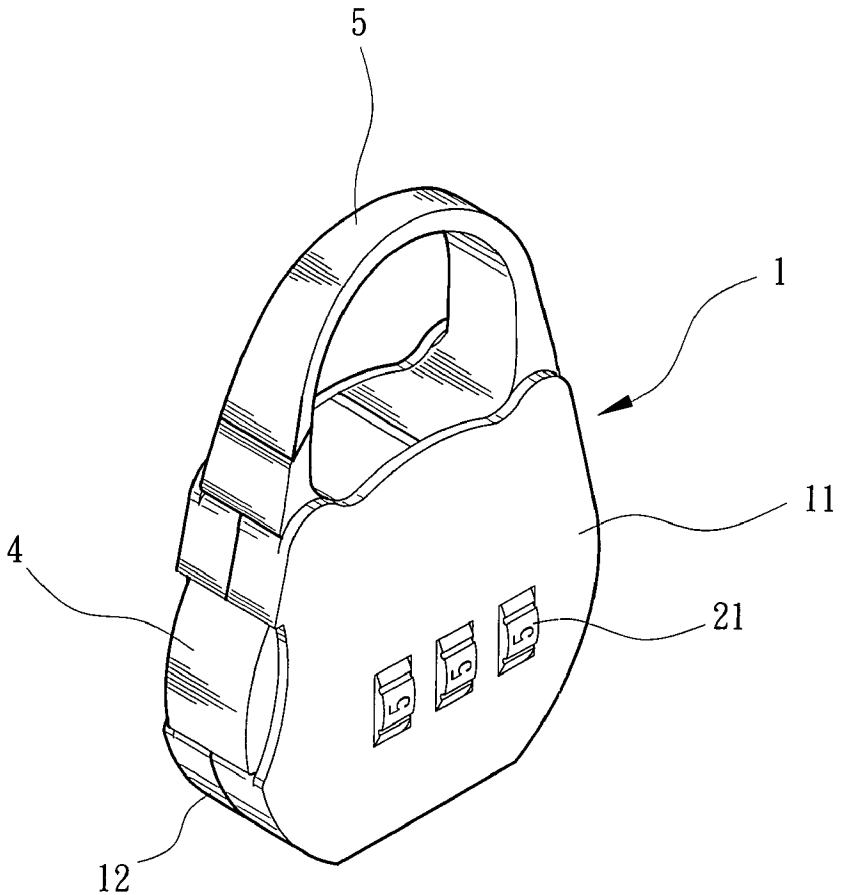
FIG. 2 is a perspective assembled view of the first embodiment of the present invention.

Please refer to FIGS. 1 and 2. According to a first embodiment, the present invention includes a lock housing 1, a first (private ) lock mechanism 2, a second (common ) lock mechanism 3, a first locking member 4 and a second locking member 5. The lock housing 1 is composed of a casing 12 and a cover body 11 mated with each other. The casing 12 is formed with a first receiving cavity 121 and a second receiving cavity 122 separated from each other. In addition, the periphery of the casing 12 is formed with an upper pivot hole 123 and a lateral hollow section 124. The center of the cover body 11 is formed with multiple numeral windows 111 corresponding to the first receiving cavity 121 of the casing 12. One side of the cover body 11 is formed with an upper pivot hole 113 corresponding to the upper pivot hole 123 of the casing 12. Another side of the cover body 11 is formed with a lower pivot hole 112 corresponding to the lateral hollow section 124. The first locking member 4 has a base end 40 having a transverse projecting shaft 41. The projecting shaft 41 is fitted in the lower pivot hole 112 of the cover body 11 to pivotally connect with the cover body 11. A middle section of the first locking member 4 outward extends from the lateral hollow section 124 of the casing 12. The other end of the first locking member 4 is a free end formed with a slope 42. The second locking member 5 has a base end 50 having two transverse projecting shafts 51 on two sides. The projecting shafts 51 are respectively fitted in the upper pivot holes 113, 123 of the cover body 11 and the casing 12 to pivotally connect with the cover body 11 and the casing 12. A middle section of the second locking member 5 is formed with a restricting section 54. A resilient member 53 is disposed on the middle section of the second locking member 5 for outward pushing the restricting section 54. The other end of the second locking member 5 is a free end formed with a slope 52 corresponding to the free end of the first locking member 4. The free ends of the two locking members 4, 5 are connectable to form a hanging hook 45. The first (private ) lock mechanism 2 is composed of multiple numeral wheels 21, a numeral lock core 22, a resilient member 23 and a lock bolt 24. The numeral wheels 21 are fitted around the middle of the lock core 22 for controlling movement thereof. The lock bolt 24 is connected with one end of the lock core 22. The resilient member 23 is disposed between the lock bolt 24 and the lock core 22 for outward pushing the lock bolt 24 to resiliently abut against the middle section of the first locking member 4. The second (common ) lock mechanism 3 is composed of a lock core 31, a dogging section 32 drivable by the lock core 31 and a lock bolt 33. The lock core 31 is drivable by a key to control the rotation of the dogging section 32. An end section 331 of the lock bolt 33 is drivingly connected with the dogging section 32. The lock bolt 33 is restricted by the restricting section 54 of the second locking member 5 for restricting the movement of the second locking member 5.

Figure 4:
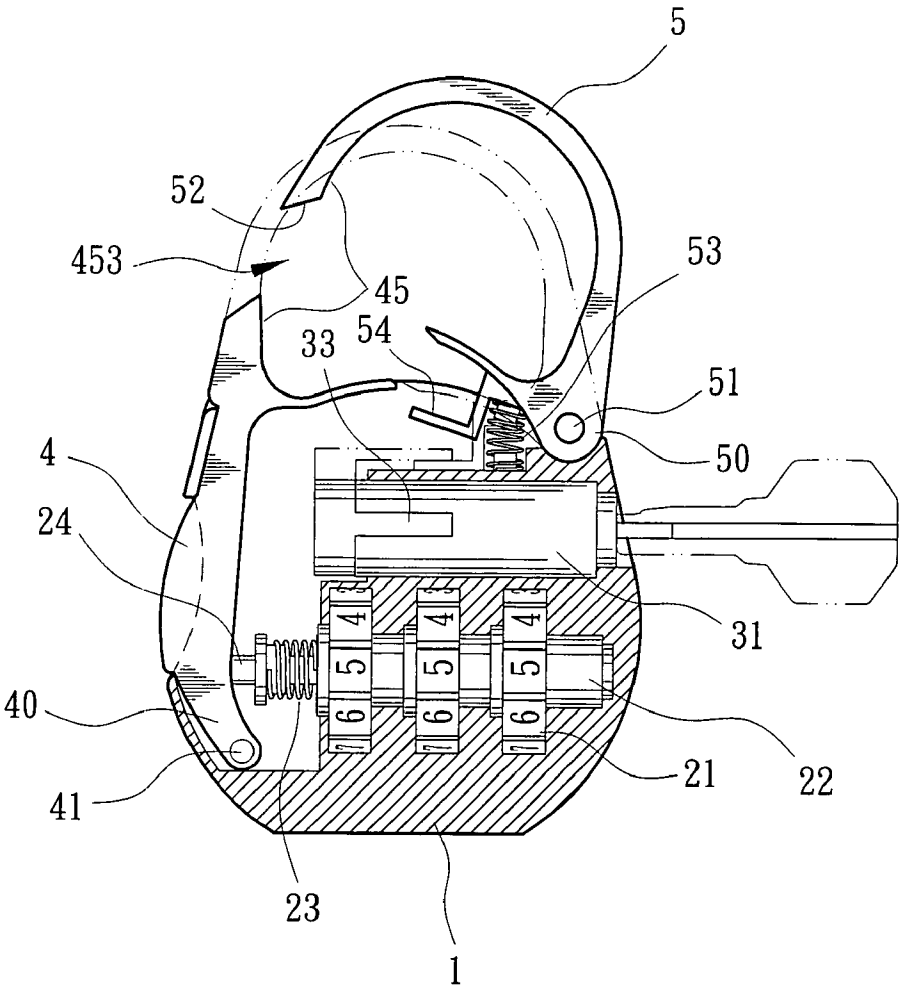
FIG. 4 is a sectional view of the first embodiment of the present invention, showing that the first embodiment is unlocked by means of a key.
Figure 3:
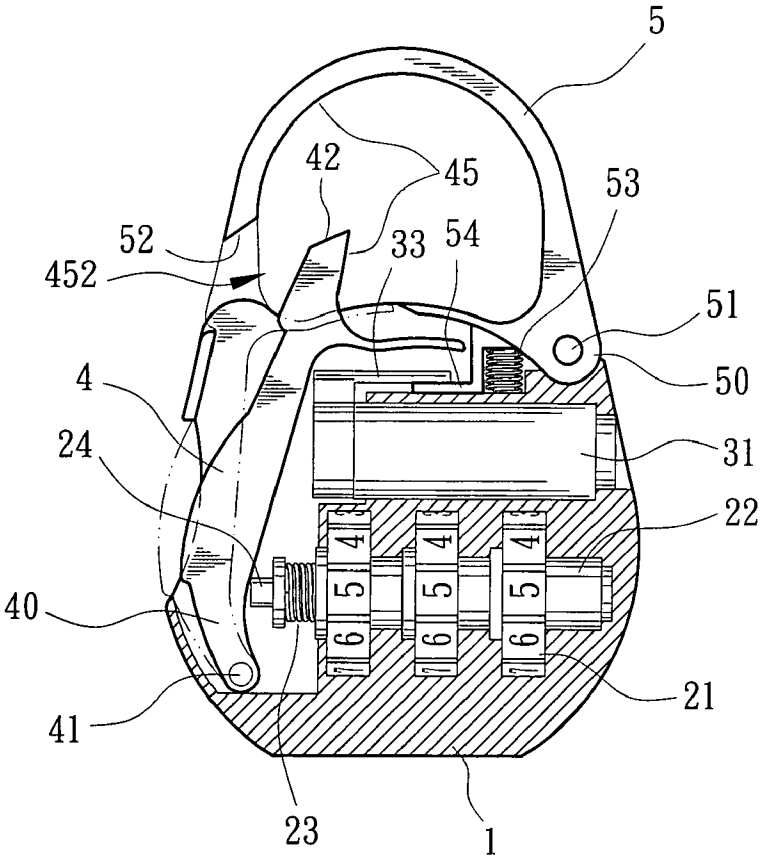
FIG. 3 is a sectional view of the first embodiment of the present invention, showing that the first embodiment is unlocked by means of turning the numeral wheels.

FIGS. 3 and 4 respectively show that the first embodiment of the present invention is unlocked by means of turning the numeral wheels 21 and using a key. When the numeral wheels 21 are turned to a correct unlocking position, the numeral lock core 22 is released from the engagement. At this time, the first locking member 4 can be inward pressed to compress the resilient member 23 and drive the lock bolt 24. At the same time, the slope 42 of the first locking member 4 is moved away from the slope 52 of the second locking member 5, whereby an unlocking gap 452 is defined between the slopes 42, 52 as shown in FIG. 3. Moreover, in the case that a preset key is inserted into the lock core 31 to turn the dogging section 32, the lock bolt 33 can be rotated to release the restricting section 54 from the restriction. At this time, by means of the resilient outward pushing force of the resilient member 53, the second locking member 5 is pivotally outward turned about the base end 50. Accordingly, the slope 52 of the free end of the second locking member 5 is displaced away from the slope 42 of the first locking member 4 to define an unlocking gap 453 as shown in FIG. 4.

Figure 5:
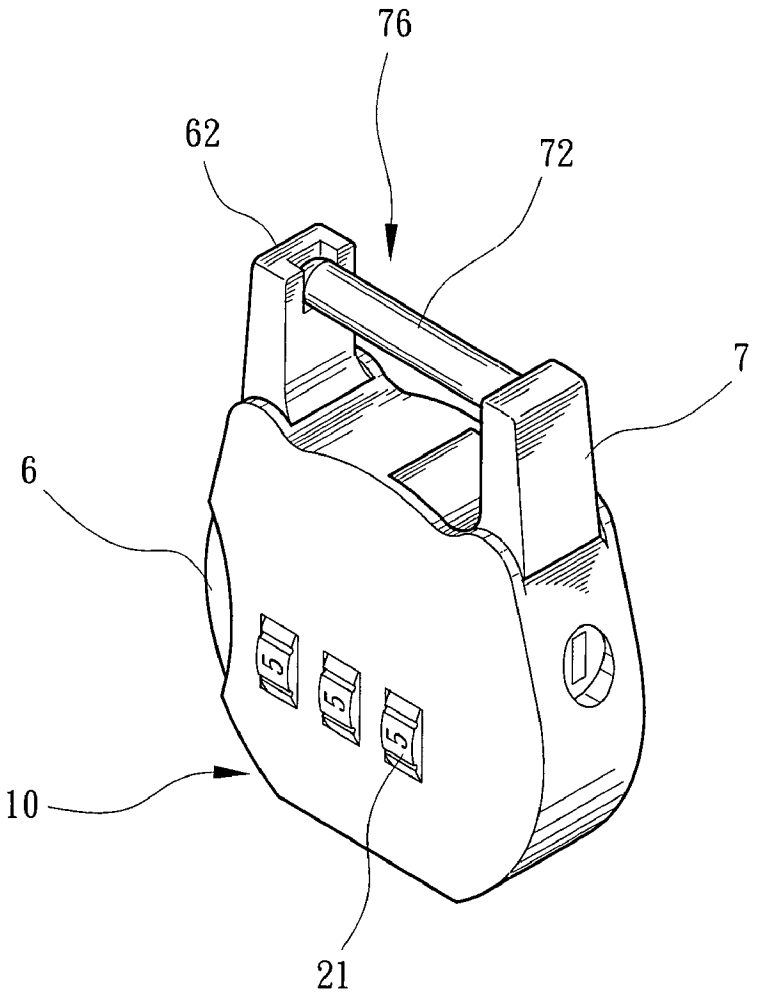
FIG. 5 is a perspective assembled view of a second embodiment of the present invention in a locked state.
Figure 6:
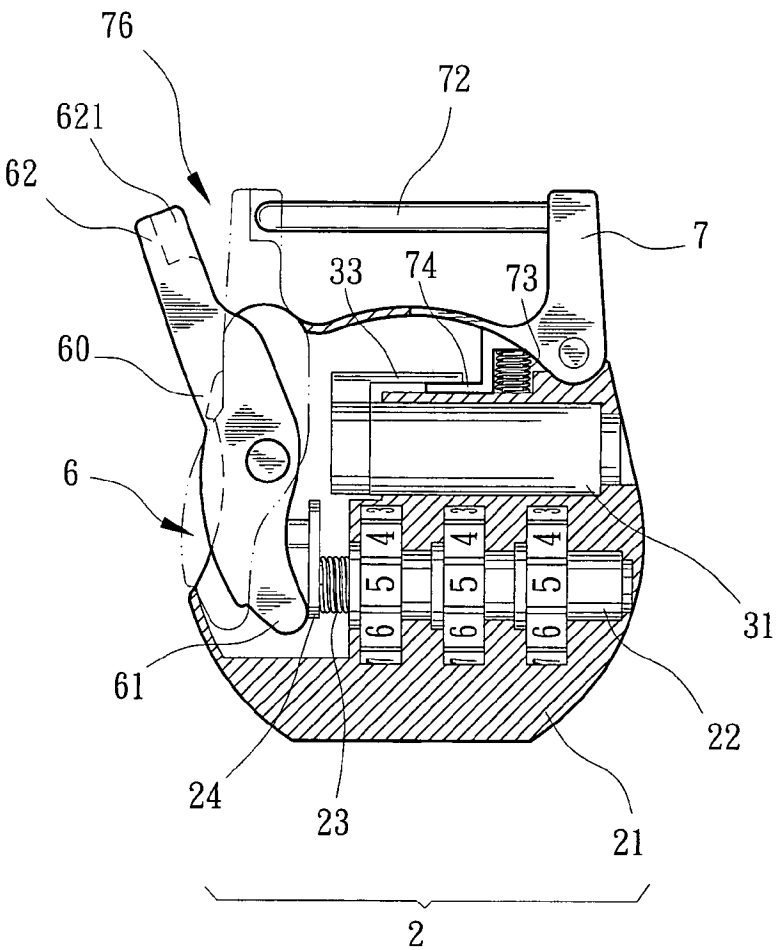
FIG. 6 is a sectional view of the second embodiment of the present invention, showing that the second embodiment is unlocked by means of turning the numeral wheels.
Figure 7:
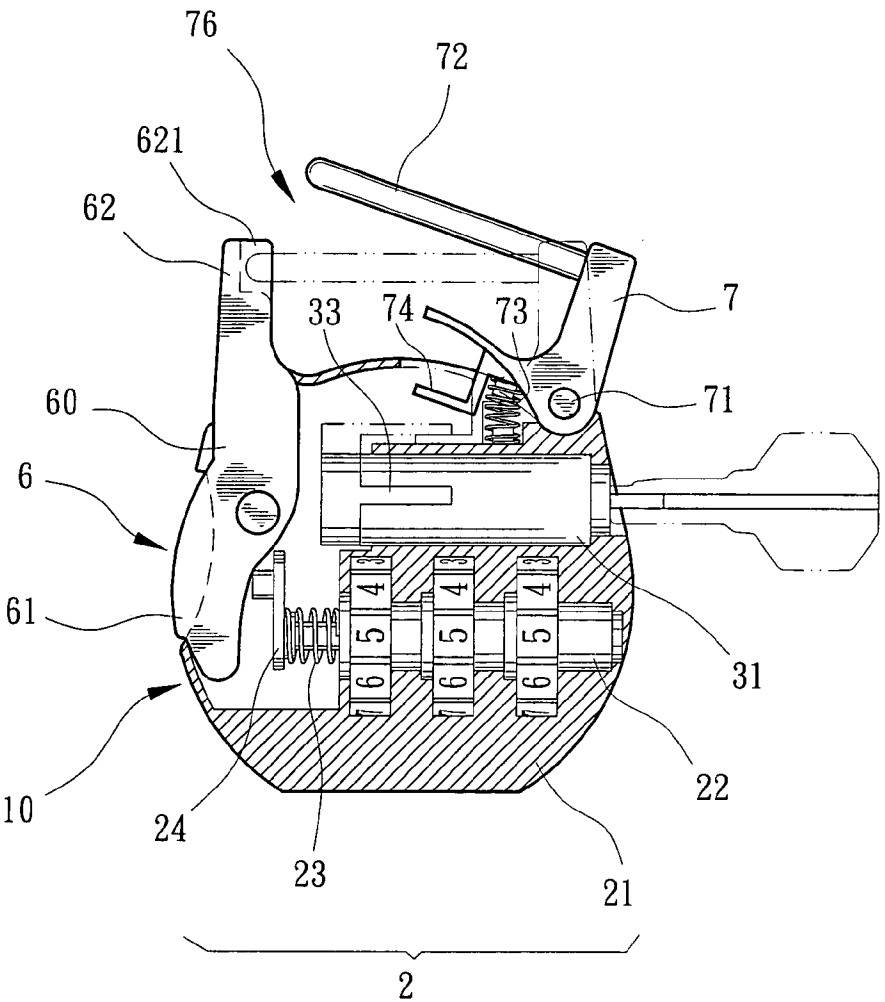
FIG. 7 is a sectional view of the second embodiment of the present invention, showing that the second embodiment is unlocked by means of a key.

FIG. 5 shows a second embodiment of the present invention. FIGS. 6 and 7 respectively show that the second embodiment of the present invention is unlocked by means of turning the numeral wheels and using a key. A first (private) lock mechanism 2 and a second (common) lock mechanism 3 identical to those of the first embodiment are disposed in the lock housing 10. A first locking member 6 and a second locking member 7 are arranged on one side of the lock housing 10. A middle section 60 of the first locking member 6 is pivotally disposed on the lock housing 10. The inner and outer ends 61, 62 of the first locking member 6 can be freely swung. The lock bolt 24 of the first (private) lock mechanism 2 outward resiliently pushes the inner end 61. The center of the outer end 62 is formed with a notch 621. The base end 71 of the second locking member 7 is pivotally disposed on the lock housing 10. The middle section of the second locking member 7 has a restricting section 74 extending into the lock housing 10. The restricting section 74 is outward pushed by a resilient member 73. The restricting section 74 is dogged by the lock bolt 33 of the second (common) lock mechanism 3. The second locking member 7 has a projecting lock bar 72 positioned on outer side of the lock housing 10. An outer end 721 of the lock bar 72 extends into the notch 621 of the first locking member 6 to form a hanging hook. When the numeral wheels 21 of the first lock mechanism 2 are turned to a correct unlocking position, the lock bolt 24 is released from the locking. At this time, the inner end 61 of the first locking member 6 can be inward pressed to push the lock bolt 24 and compress the resilient member 23. At the same time, the notch 621 of the outer end 62 of the first locking member 6 is outward pivotally rotated, whereby an unlocking gap 76 is defined between the notch 621 and the outer end 721 of the lock bar 72 as shown in FIG. 6. In the case that a preset key is inserted into the lock core 31, the lock bolt 33 can be rotated to release the restricting section 74 from the restriction. At this time, by means of the resilient outward pushing force of the resilient member 73, the second locking member 7 is pivotally outward turned about the base end 71 thereof. Accordingly, the outer end 721 of the lock bar 72 is separated from the notch 621 of the first locking member 6 to define an unlocking gap 76 as shown in FIG. 7.

Figure 9:
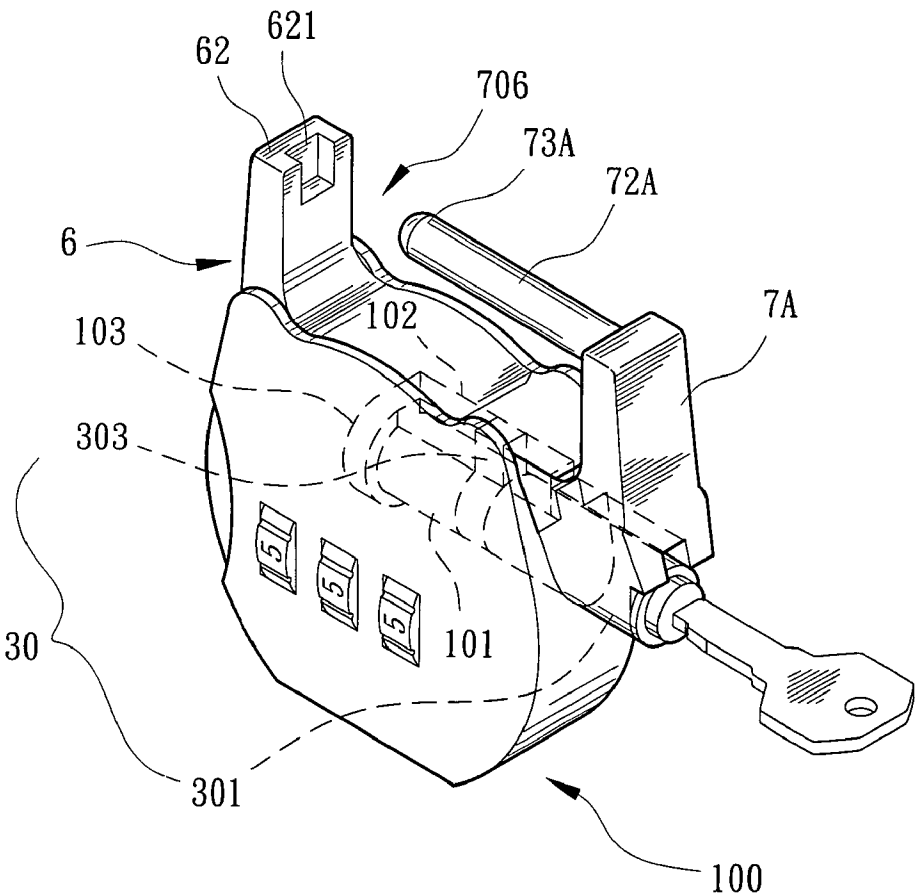
FIG. 9 is a perspective view of the third embodiment of the present invention, showing that the third embodiment is unlocked by means of a key.
Figure 8:
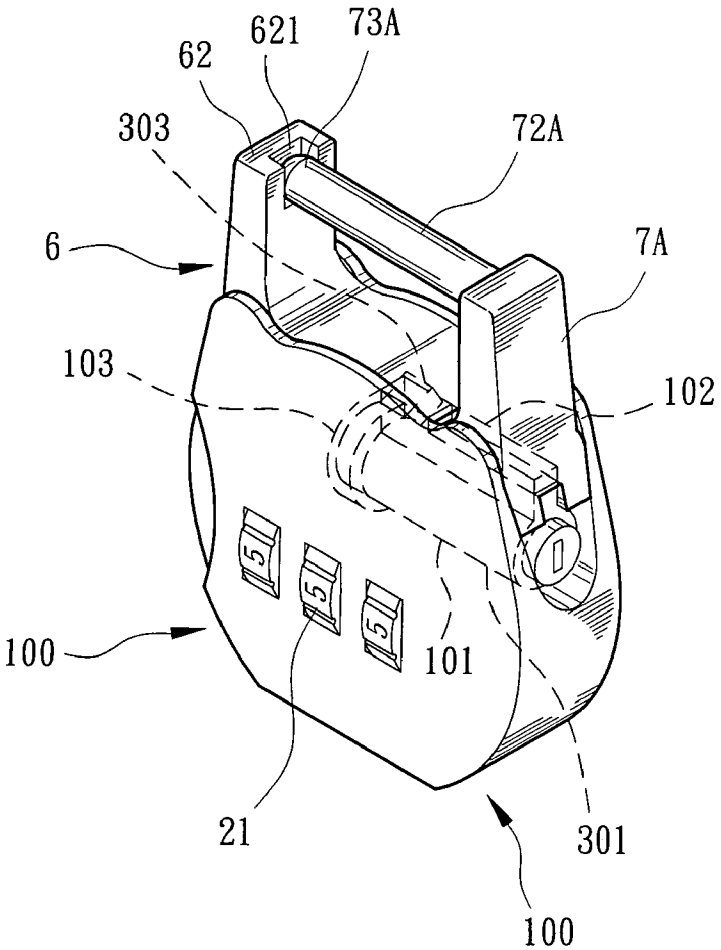
FIG. 8 is a perspective assembled view of a third embodiment of the present invention in a locked state.

FIG. 8 shows a third embodiment of the present invention in a locked state. FIG. 9 shows that the third embodiment of the present invention is unlocked by means of a key. A first (private) lock mechanism 2 and a first locking member 6 similar to the second embodiment are disposed in the lock housing 100. A second receiving cavity 101 is formed in the lock housing 100. One side of the second receiving cavity 101 has an axially extending channel 102. A lock core 301 connected with a second locking member 7A is received in the second receiving cavity 101. An annular groove 103 is formed at inner end of the second receiving cavity 101. The inner end of the lock core 301 of the second (common) lock mechanism 30 can drive a projecting block 303 transversely extending into the annular groove 103. The second locking member 7A has a projecting lock bar 72A positioned on outer side of the lock housing 100. The outer end 73A of the lock bar 72A can extend into the notch 621 of the first locking member 6 to form a hanging hook. When a preset key is inserted into the lock core 301, the projecting block 303 can be rotated and aligned with the channel 102 beside the second receiving cavity 101. Under such circumstance, the lock core 301 can be drawn out along the channel 102. At this time, the lock bar 72A of the second locking member 7A is slid along with the lock core 301 in a direction away from the first locking member 6. Accordingly, an unlocking gap 706 is defined between the outer end 73A of the lock bar 72A and the notch 621 as shown in FIG. 9. Also, this embodiment can be unlocked by means of turning the first (private) lock mechanism 2 to drive the first locking member 6. Such operation is identical to that of the second embodiment and will not be repeatedly described hereinafter.

Figure 11:
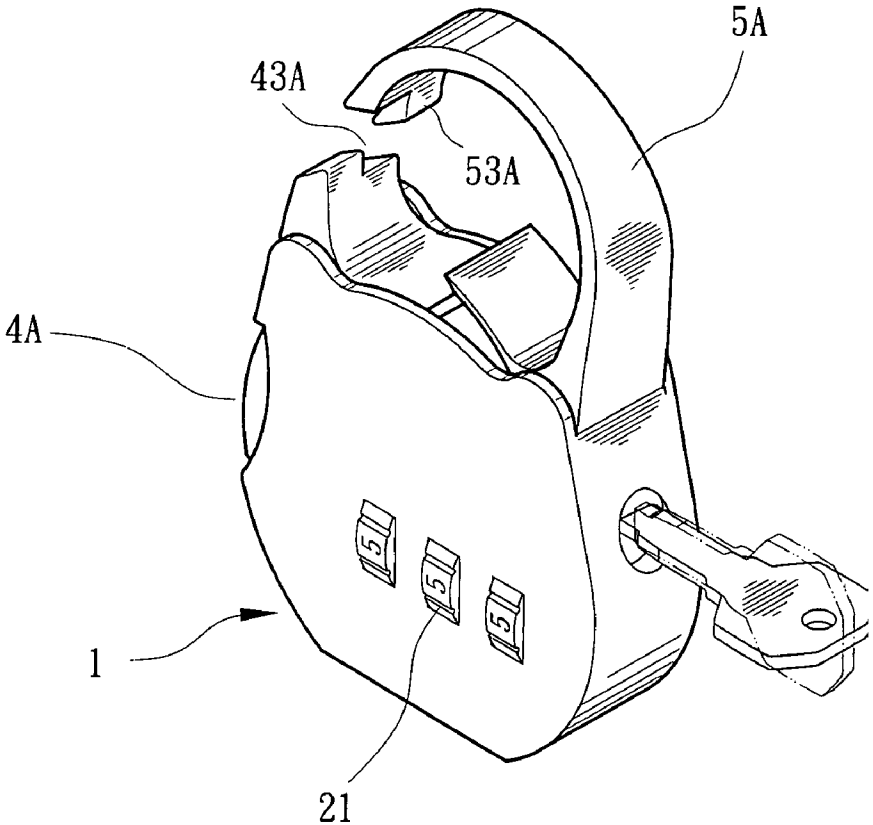
FIG. 11 is a perspective view of a fifth embodiment of the present invention, showing that the fifth embodiment is unlocked by means of a key.
Figure 10:
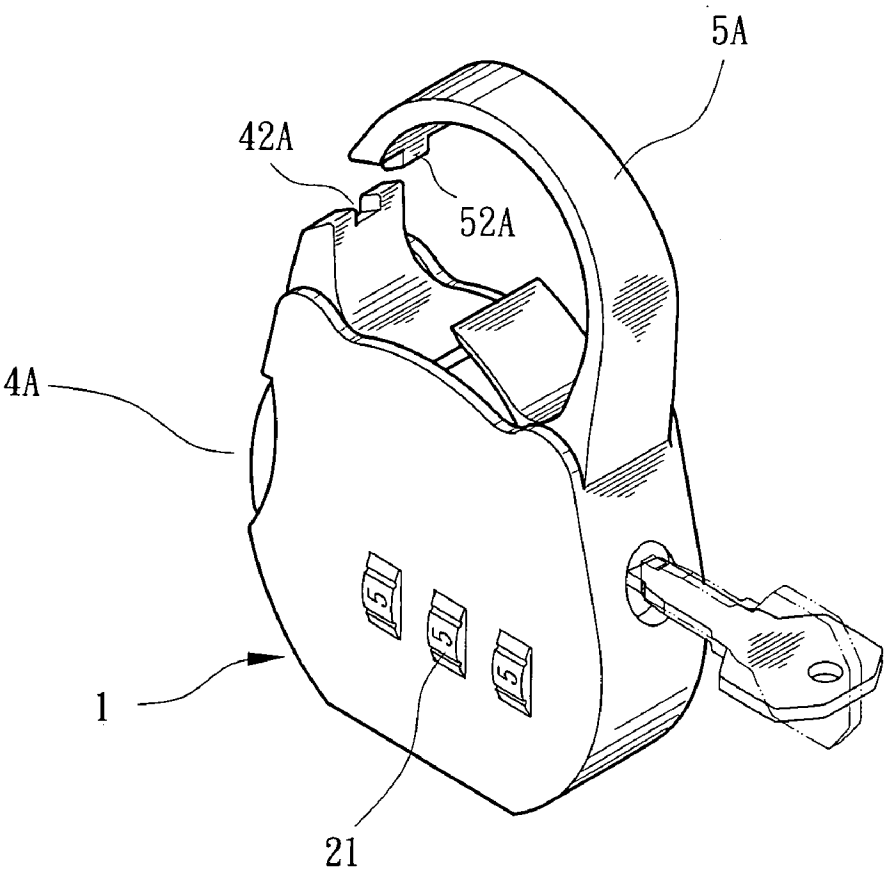
FIG. 10 is a perspective view of a fourth embodiment of the present invention, showing that the fourth embodiment is unlocked by means of a key.

FIGS. 10 and 11 respectively show a fourth and a fifth embodiments of the present invention, which are unlocked by a key. Each of the fourth and fifth embodiments has a lock housing 1 in which a first (private) lock mechanism 2 and a second (common) lock mechanism 3 are disposed. The lock housing 1 and the first and second lock mechanisms 2, 3 are identical to those of the first embodiment. A first and a second locking members 4A, 5A similar to the first and second locking members 4, 5 of the first embodiment are drivable by the first and second lock mechanisms 2, 3. The difference between these embodiments and the first embodiment is that the free ends of the locking members 4A, 5A are formed with stepped or recessed sections 42A, 43A, 52A, 53A which are complementary to each other. These embodiments can be unlocked by means of using the first (private) lock mechanism 2 or the second (common) lock mechanism 3 for driving the first locking member 4A or the second locking member 5A. Such operation is identical to that of the first embodiment and will not be repeatedly described hereinafter.

Figure 12:
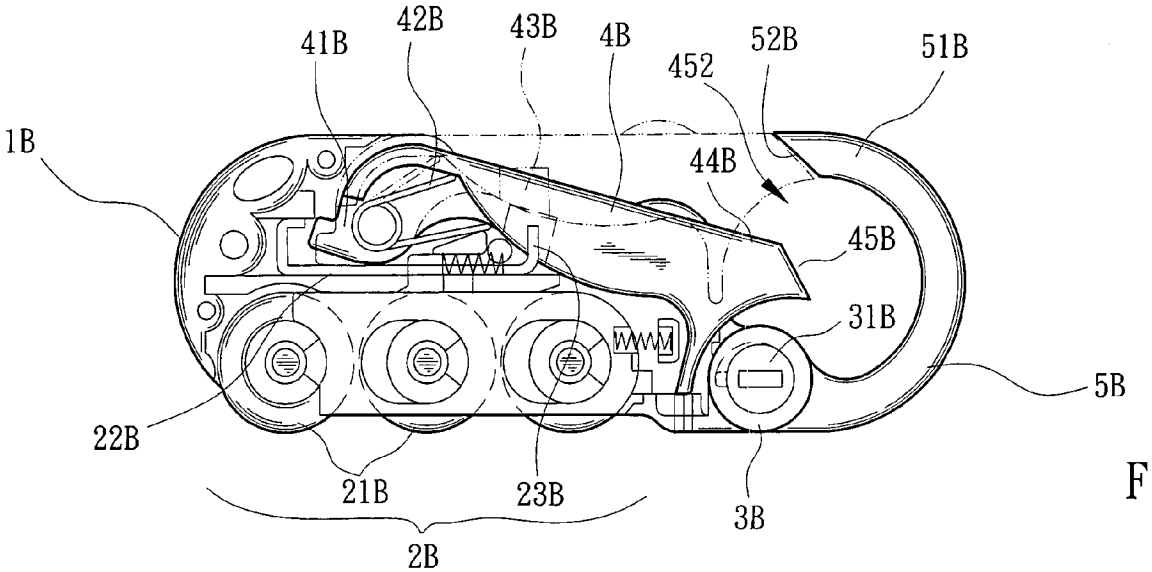
FIG. 12 is a sectional view of a sixth embodiment of the present invention, showing that the sixth embodiment is unlocked by means of turning the numeral wheels.
Figure 13:
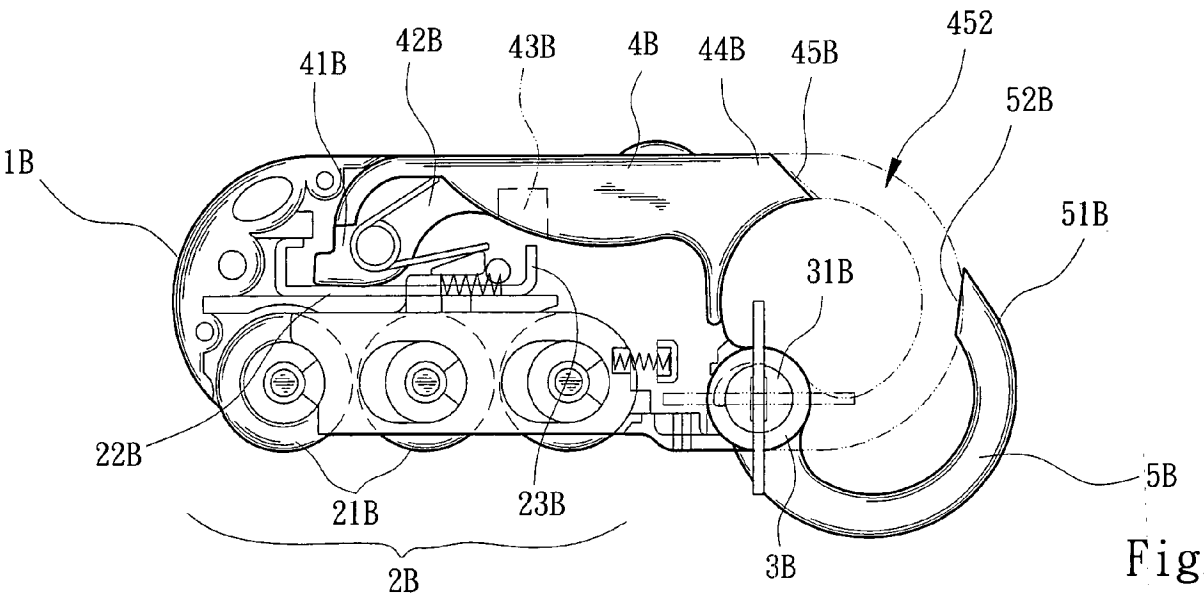
FIG. 13 is a sectional view of the sixth embodiment of the present invention, showing that the sixth embodiment is unlocked by means of a key.

FIGS. 12 and 13 are sectional views showing the structure of a sixth embodiment of the present invention and the unlocking operation thereof. This embodiments has a lock housing 1B in which a first (private) lock mechanism 2B and a second (common) lock mechanism 3B are disposed. According to the positions of the numeral wheels 21B of the first (private) lock mechanism 2B, the movement of a dogging member 22B is controllable. One end of the dogging member 22B has a perpendicularly projecting abutting section 23B. A base end 41B of a first locking member 4B is pivotally disposed on inner periphery of the lock housing 1B. In normal state, a resilient member 42B resiliently outward pushes the first locking member 4B to locate the first locking member 4B. In addition, the middle of inner side of the first locking member 4B is formed with a recessed section 43B. The other end of the first locking member 4B is a free end 44B having a slope 45B. The second locking member 5B has a base end 51B drivingly connected with the lock core 31B of the second (common) lock mechanism 3B. The second locking member 5B has an outward extending end extending toward the first locking member 4B. The outward extending end is formed with a slope 52B adapted to the slope 45B of the first locking member 4B. The free ends of the first and second locking members 4B, 5B can be complementarily connected to form a hanging hook.

When the numeral wheels 21B are turned to a correct unlocking position, the dogging member 22B is released from the locking. At this time, the projecting abutting section 23B of the dogging member 22B can be pushed to a position aligned with the recessed section 43B of the first locking member 4B. At this time, the first locking member 4B can be inward pressed and the projecting abutting section 23B of the dogging member 22B will extend into the recessed section 43B of the first locking member 4B without stopping the first locking member 4B. Accordingly, the slope 41B of the free end of the first locking member 4B is separated from the slope 52B of the outward extending end of the second locking member 5B to define an unlocking gap 452 as shown in FIG. 12. In the case that a preset key is inserted into the lock core 31B of the second (common) lock mechanism 3B, the lock bolt can be rotated to drive the second locking member 5B. At this time, an unlocking gap 452 is defined between the slope 52B of the outward extending end of the second locking member 5B and the slope 41B of the free end of the first locking member 4B as shown in FIG. 13.

The above embodiments are only used to illustrate the present invention, not intended to limit the scope thereof. Many modifications of the above embodiments can be made without departing from the spirit of the present invention.

What is claimed is:

1. A security check hanging lock structure comprising:

a lock housing;

a first locking member pivotally disposed in the lock housing, at least one end of the first locking member being a free end protruding outwardly from the lock housing and swung between two positions;

a first lock mechanism disposed in the lock housing for controlling the first locking member to be locked or unlocked;

a second lock mechanism disposed in the lock housing and having a key-driven lock core; and a second locking member having a base end and a free end extending outwardly from the lock housing toward the first locking member, the free ends of the first and second locking members being connectable on an exterior of the lock housing to form a hanging hook, the base end of the second locking member being connected with the second lock mechanism, whereby by means of the two lock mechanisms, the free ends of the two locking members are respectively operated to open or close the hanging hook so as to lock or unlock the hanging lock, wherein when the key-driven lock core is unlocked, the second locking member is directly synchronously driven to pivotally rotate about the base end of the second locking member, whereby the free end of the second locking member is controlled to separate from the free end of the first locking member.

2. The security check hanging lock structure as claimed in claim 1, wherein the free ends of the first and second locking members are formed with complementary slopes.

3. The security check hanging lock structure as claimed in claim 1, wherein the first lock mechanism is composed of multiple numeral wheels, a lock core, a resilient member and a lock bolt, the numeral wheels serving to control movement of the lock core, the lock bolt being disposed at one end of the lock core, the resilient member being disposed between the lock bolt and the lock core, whereby in normal state, the resilient member resiliently pushing the lock bolt to resiliently abut against inner side of the first locking member.

4. The security check hanging lock structure as claimed in claim 2, wherein the first lock mechanism is composed of multiple numeral wheels, a lock core, a resilient member and a lock bolt, the numeral wheels serving to control movement of the lock core, the lock bolt being disposed at one end of the lock core, the resilient member being disposed between the lock bolt and the lock core, whereby in normal state, the resilient member resiliently pushing the lock bolt to resiliently abut against inner side of the first locking member.

5. The security check hanging lock structure as claimed in claim 1, wherein the second lock mechanism is composed of the key-driven lock core and a dogging section synchronously drivingly disposed at one end of the lock core, the dogging section serving to directly restrict the base end of the second locking member for controlling the movement thereof.

6. The security check hanging lock structure as claimed in claim 2, wherein the second lock mechanism is composed of the key-driven lock core and a dogging section synchronously drivingly disposed at one end of the lock core, the dogging section serving to directly restrict the base end of the second locking member for controlling the movement thereof.

7. The security check hanging lock structure as claimed in claim 3, wherein the second lock mechanism is composed of the key-driven lock core and a dogging section synchronously drivingly disposed at one end of the lock core, the dogging section serving to directly restrict the base end of the second locking member for controlling the movement thereof.

8. The security check hanging lock structure as claimed in claim 4, wherein the second lock mechanism is composed of the key-driven lock core and a dogging section synchronously drivingly disposed at one end of the lock core, the dogging section serving to directly restrict the base end of the second locking member for controlling the movement thereof.

9. The security check hanging lock structure as claimed in claim 1, wherein the second lock mechanism is composed of the key-driven lock core and a lock bolt drivingly connected with one end of the lock core, the lock bolt serving to restrict a corresponding restricting section preset on the base end of the second locking member so as to control the movement of the second locking member.

10. The security check hanging lock structure as claimed in claim 2, wherein the second lock mechanism is composed of the key-driven lock core and a lock bolt drivingly connected with one end of the lock core, the lock bolt serving to restrict a corresponding restricting section preset on the base end of the second locking member so as to control the movement of the second locking member.

11. The security check hanging lock structure as claimed in claim 3, wherein the second lock mechanism is composed of the key-driven lock core and a lock bolt drivingly connected with one end of the lock core, the lock bolt serving to restrict a corresponding restricting section preset on the base end of the second locking member so as to control the movement of the second locking member.

12. The security check hanging lock structure as claimed in claim 4, wherein the second lock mechanism is composed of the key-driven lock core and a lock bolt drivingly connected with one end of the lock core, the lock bolt serving to restrict a corresponding restricting section preset on the base end of the second locking member so as to control the movement of the second locking member.

* * * * *